US006170149B1

(12) United States Patent
Oshiki et al.

(10) Patent No.: US 6,170,149 B1
(45) **Date of Patent: *Jan. 9, 2001**

(54) MAGNETORESISTIVE TYPE MAGNETIC HEAD AND METHOD OF MANUFACTURING THE SAME AND APPARATUS FOR POLISHING THE SAME

(75) Inventors: Mitsumasa Oshiki; Nobuo Iijima, both of Kanagawa; Motoichi Watanuki, Kawasaki, all of (JP)

(73) Assignee: Fujitsu Limited, Kawasaki (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/791,821

(22) Filed: Jan. 30, 1997

(30) Foreign Application Priority Data

Apr. 30, 1996 (JP) ..... 8-108805

(51) Int. Cl.[7] ..... H04R 21/00; B24B 49/00

(52) U.S. Cl. ..... 29/603.09; 29/603.15; 29/603.16; 29/737; 451/5; 451/1

(58) Field of Search ..... 29/603.15, 603.16, 29/603.17, 603.09, 737; 451/5, 1; 338/32 R, 195; 360/327.23, 327.31

(56) References Cited

U.S. PATENT DOCUMENTS

| | | | | |
|---|---|---|---|---|
| 3,706,926 | * | 12/1972 | Barrager et al. | 29/603.15 |
| 4,122,505 | * | 10/1978 | Kuijk | 338/32 R |
| 4,489,484 | * | 12/1984 | Lee | 29/603.16 |
| 4,829,658 | * | 5/1989 | Pichler et al. | 29/603.09 |
| 4,914,868 | * | 4/1990 | Church et al. | 29/609.09 |
| 4,972,284 | * | 11/1990 | Smith et al. | 360/113 |
| 4,978,938 | * | 12/1990 | Partin et al. | 338/32 R |
| 5,243,316 | * | 9/1993 | Sakakima et al. | 338/32 R |
| 5,264,980 | * | 11/1993 | Mowry et al. | 360/113 |
| 5,306,573 | * | 4/1994 | Pirot et al. | 428/692 |
| 5,500,590 | * | 3/1996 | Pant | 338/32 R |
| 5,609,511 | * | 3/1997 | Moriyama et al. | 451/5 |
| 5,621,320 | * | 4/1997 | Yokotani et al. | 338/32 R |
| 5,722,155 | * | 3/1998 | Stover et al. | 29/603.16 |
| 5,737,155 | * | 4/1998 | George et al. | 360/113 |
| 5,772,493 | * | 6/1998 | Rottmayer et al. | 451/5 |
| 5,808,273 | * | 9/1998 | Galster et al. | 338/195 |

FOREIGN PATENT DOCUMENTS

| | | |
|---|---|---|
| 60-191418 | 9/1985 | (JP) . |
| 60-202513 | 10/1985 | (JP) . |
| 6274837 | 9/1994 | (JP) . |
| 7240010 | 9/1995 | (JP) . |
| 7249210 | 9/1995 | (JP) . |

OTHER PUBLICATIONS

Ohanian, Hans. C, Physics, pp. 669, 722, 743, 1985.*

* cited by examiner

*Primary Examiner*—Lee Young
*Assistant Examiner*—A. Dexter Tugbang
(74) *Attorney, Agent, or Firm*—Greer, Burns & Crain, LTD

(57) ABSTRACT

According to a method of manufacturing a magnetic head, a magnetoresistive device is formed on a substrate, a top end portion of the magnetoresistive device is placed in an external magnetic field, and a height of the magnetic head is adjusted by ceasing a polishing operation at an instant when change in resistance of the magnetoresistive device relative to change in the external magnetic field comes up to a predetermined value.

13 Claims, 8 Drawing Sheets

$R_F$ : Predetermined

FIG.3A
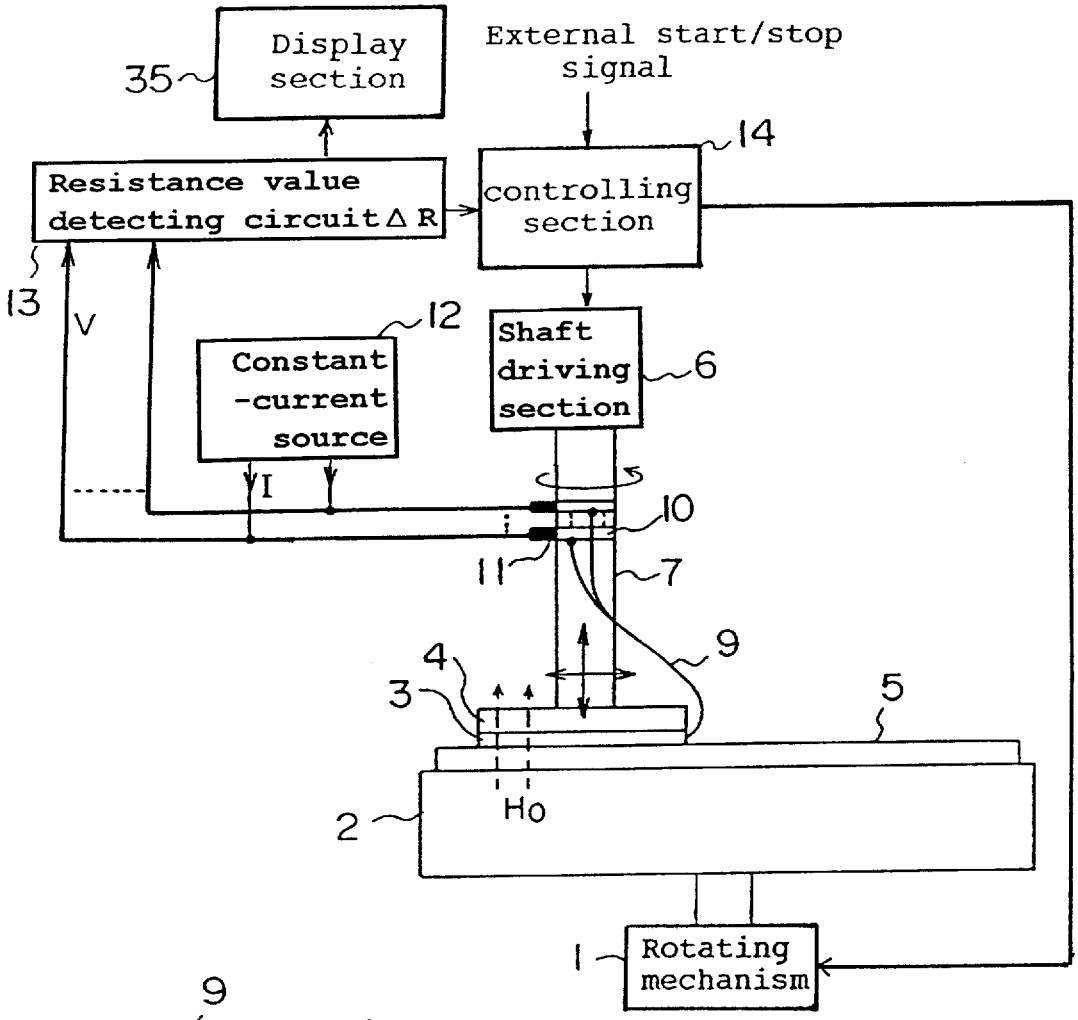
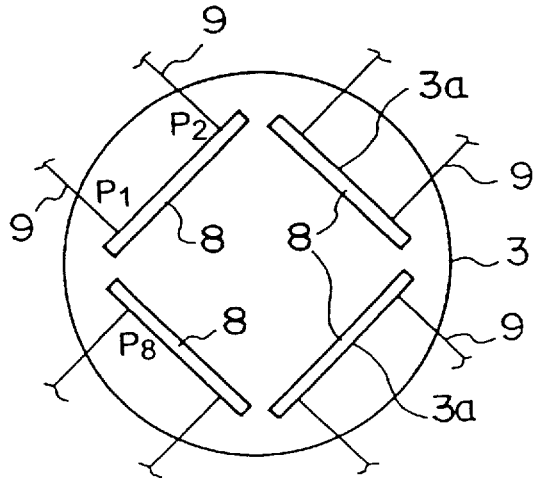
FIG.3B

MAGNETORESISTIVE TYPE MAGNETIC HEAD AND METHOD OF MANUFACTURING THE SAME AND APPARATUS FOR POLISHING THE SAME

BACKGROUND OF THE INVENTION

1. Field of the Invention

The present invention relates to a magnetoresistive head, a method of manufacturing the same, and an apparatus for manufacturing the same and, more particularly, a method of manufacturing a magnetoresistive head including a shaping step that includes polishing the magnetoresistive head, a magnetoresistive head obtained by the method, and an apparatus for manufacturing the magnetoresistive head.

2. Description of the Prior Art

A reproduction magnetic head for a high density magnetic disk apparatus has a magnetoresistive device in which electric resistance is varied according to intensity of a magnetic field. As a magnetoresistive head (referred to as a "MR head" hereinafter), there are AMR (anisotropic magnetoresistive) heads that use an anisotropic magnetoresistive effect, spin valve heads that use a spin valve effect, and the like.

In the MR head, change in resistance may be detected as change in voltage by supplying a constant current to a sense area for a signal magnetic field. It is not preferable that the sense area has too small resistance value since change in resistance caused by the signal magnetic field becomes small.

For this reason, the resistance value of the MR head has been adjusted appropriately. As one method of adjusting such resistance value, there is a method of polishing a top end of a pattern that is part of the MR head. In this case, the MR head which is formed on a rod-like block cut out from a wafer is polished.

As methods of optimizing a polishing amount of the MR head, two following methods have been adopted. These two methods are similar in that the rod-like block and the MR head are polished simultaneously with abutting the top end of the MR head formed on the rod-like block to an abrasive cloth, but different in a process of monitoring—therefor; a polishing amount.

In the first method, as shown in FIG. 1, on a rod-like block 101 polished with an abrasive cloth 100, a polishing amount is measured by observing optically a height of monitoring patterns 103 which are arranged on the both sides of the MR head 102 by a microscope or the like.

However, since the monitoring patterns 103 to be measured optically, as well as the MR head 102, are covered with a protection film (not shown), sometimes dual images of the monitoring patterns 103 are observed because of optical irregular reflection by the protection film. This causes reduction in measuring precision.

In the second method, as shown in FIG. 2A, on the rod-like block 101 polished with the abrasive cloth 100, monitoring wirings 105 are first connected to conductive monitoring patterns 104 which are arranged on the both sides of the MR head 102, and resistance values of the monitoring patterns 104 are then measured by supplying electric current to the monitoring patterns 104.

Measurement of change in the resistance value by polishing operation may be carried out with respect to the MR head 102. A relationship between polishing dimension of the MR head 102 and the resistance value RF and a relationship between polishing dimension of the monitoring patterns 104 and the resistance value RF have been given as curves A and B in FIG. 2B, for example. Therefore, polishing dimension may be calculated based on the resistance value. In other words, in principle, a desired dimension has been polished when a predetermined resistance value has been detected.

However, since there exist variation of contact resistance and error of every manufacturing step in the monitoring patterns 104 and the MR head 102, respective rod-like blocks 101 are likely to exhibit uneven characteristic curves A and B in FIG. 2B even if the monitoring patterns 103 and the MR head 102 are formed to have the same structure. If the characteristic curves deviate from each other, different polishing dimensions are caused even if the same resistance value has obtained after polishing, which results in uneven characteristics of the devices.

Furthermore, in the above two polishing method, there is a disadvantage that much time and labor are required for polishing operation since the polishing is interrupted to monitor polishing states.

SUMMARY OF THE INVENTION

An object of the present invention is to provide a method of manufacturing a magnetoresistive head capable of monitoring an optimum polishing location without interruption of polishing and making characteristics of the MR devices uniform after polishing, a magneto-resistive type magnetic head obtained by this method, and an apparatus for manufacturing a magnetoresistive head.

According to the present invention, a top end portion of a magnetoresistive device is polished while applying a magnetic field to the magnetoresistive device, and polishing operation is terminated at an instance when change in resistance value relative to change in the magnetic field reaches a predetermined value.

More particularly, the present invention is characterized in that an end point of polishing is not determined based on the measurement of polishing dimension of monitoring patterns or overall resistance of the MR head, but an end point of polishing is detected while measuring change in magnetic field with respect to the resistance value of the MR head. According to such monitoring method, since contact resistance of the magnetoresistive device and resistance variation derived from the monitoring process can be removed a parameters for detecting the end point of polishing, variations in remaining widths of the magnetoresistive device variations can be made small after which results in uniform device characteristics.

In addition, according to a method of polishing the magnetoresistive device making use of such monitoring, necessity of interruption is avoided to monitor polishing of the magnetoresistive device. Further, if an amount of change in resistance is set in advance to determine an end point of polishing, such end point of polishing can be easily determined so that automatic detection of the end point of polishing can be facilitated.

Furthermore, in case a plurality of magnetoresistive devices are polished simultaneously, yielding can be improved if, after variation of changes in resistance is detected, weighted distribution of polishing is reallocated so as to reduce difference in these changes in resistance. According to the above method of polishing the magnetoresistive device, the uniform MR head without variation in device characteristics can be accomplished.

Other and further objects and features of the present invention will become obvious upon an understanding of the illustrative embodiments about to be described in connection with the accompanying drawings or will be indicated in the appended claims, and various advantages not referred to herein will occur to one skilled in the art upon employing of the invention in practice.

BRIEF DESCRIPTION OF THE DRAWINGS

FIG. 3A is a view showing a configuration of a magnetic head polishing apparatus according to an embodiment of the present invention;

FIG. 3B is a bottom view showing a supporting plate used when a magnetic head is fitted to the magnetic head polishing apparatus in FIG. 3A;

DESCRIPTION OF THE PREFERRED EMBODIMENTS

Figure 1:
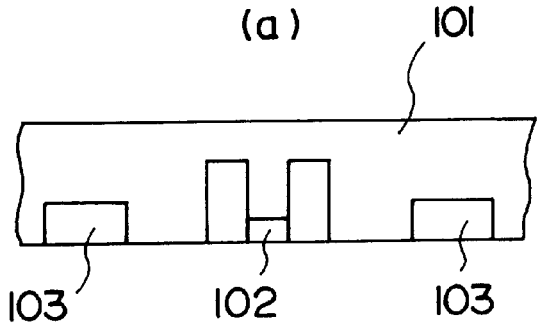
FIG.1 (Prior Art)
FIG. 1 is a plan view showing a monitoring pattern on rod-like blocks as a conventional first polishing measured object.
Figure 2A:
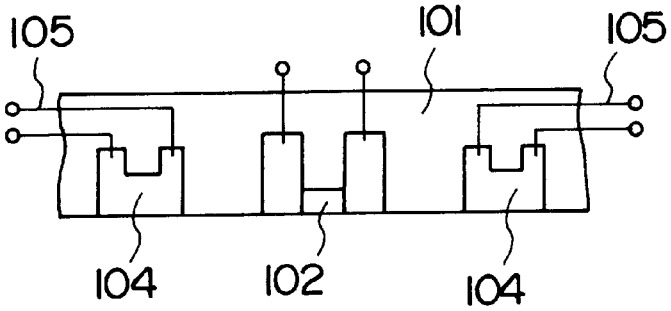
FIG.2A (Prior Art)
FIG. 2A is a plan view showing a monitoring pattern on rod-like blocks as a conventional second polishing measured object.
Figure 2B:
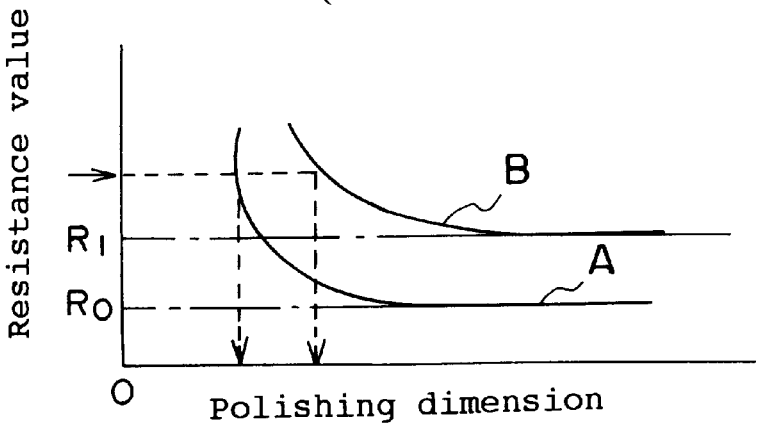
FIG.2B (Prior Art)
FIG. 2B is a graph showing a relationship between the monitoring pattern or a polished dimension of an MR device and resistance value.

There will be described various embodiments of the present invention with reference to the accompanying drawings. It should be noted that the same or similar reference numerals are applied to the same or similar parts and elements throughout the drawings, and the description of the same or similar parts and elements will be omitted or simplified.

In the present embodiment, a polishing apparatus shown in FIG. 3A is used to optimize polishing amount of an MR device.

The polishing apparatus comprises a circular disk type lower surface plate 2 rotated by a rotating mechanism 1, and a circular disk type upper surface plate 4 for supporting a supporting plate 3 via a suction pad (not shown). An abrasive cloth 5 is stuck on the lower surface plate 2 so as to oppose to the supporting plate 3. The upper surface plate 4 is fixed to an lower end of a shaft 7 which is rotated and moved vertically by a shaft driving section 6.

As shown in FIG. 3B, a plurality of recess portions 3*a* into which rod-like blocks 8 having magnetic heads thereon are fitted are formed on a lower surface of the supporting plate 3. After the rod-like blocks 8 are fitted into the recess portions 3*a*, leading wirings 9 described later are connected to the MR device 16 formed on the rod-like blocks 8. The leading wirings 9 are connected to a plurality of slip rings 10 (FIG. 3A) formed on a surface of the shaft 7 respectively.

A constant-current source 12 is connected to the slip rings 10 via brushes 11. A constant-current is supplied to the MR device via the slip rings 10, the brushes 11, and the leading wirings 9.

Further, a resistance value detecting circuit 13 is connected to the brushes 11 to measure change in resistance of the MR device according to applied magnetic field. A controlling section 14 is connected to an output terminal of the resistance value detecting circuit 13 to output at least polishing start signal and stop signal to the rotating mechanism 1 and the shaft driving section 6. The polishing stop signal is output from the controlling section 14 to the rotating mechanism 1 and the shaft driving section 6 at the time when change $\Delta R$ in the resistance value relative to change in the magnetic field detected by the resistance value detecting circuit 13 reaches a predetermined value.

Figure 4:
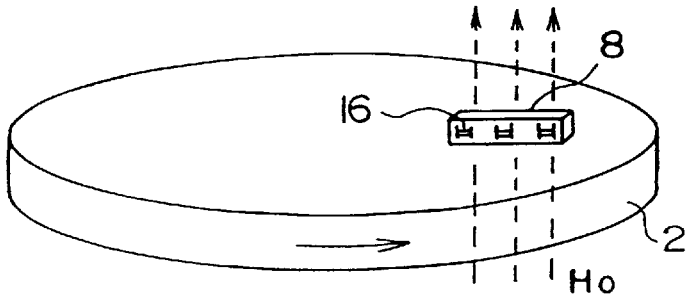
FIG. 4 is a perspective view showing an arrangement between a lower surface plate of the magnetic head polishing apparatus according to the embodiment of the present invention and the magnetic head, and location of a magnetic field applied to the magnetic head.

As shown in FIG. 4, a magnetic field applying means is arranged near the abrasive cloth 5 to apply the magnetic field H0 with predetermined intensity to the MR device 16 formed on the rod-like block 8. The magnetic field H0 is generated by the magnetic field applying means in the direction along which magnetic field is incident into the MR device 16 upon reading the magnetic disk, or the like.

As the magnetic field applying means, there can be considered those means shown in FIGS. 5A to 5D.

Figure 5A:
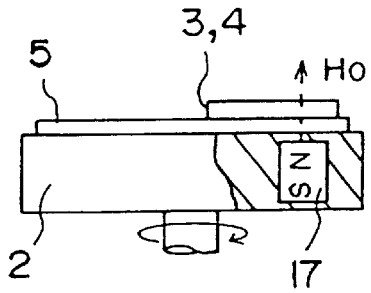
FIGS. 5A to 5D are side views showing respectively an example of a magnetic field generating means fitted to the magnetic head polishing apparatus according to the embodiment of the present invention.

The magnetic field applying means shown in FIG. 5A is made up of a permanent magnetic 17 which is buried in the lower surface plate 2. When the permanent magnetic 17 is moved back and forth with respect to the rod-like block 8 according to rotation of the upper surface plate 2, the magnetic field H0 is applied alternatively to the MR head 17 on the rod-like block 8.

Figure 5B:
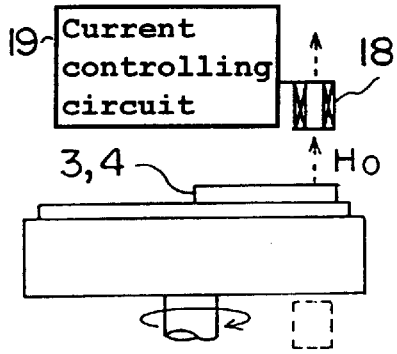

The magnetic field applying means shown in FIG. 5B includes an electromagnet 18 which is arranged over or under a moving area of the supporting plate 3 and the upper surface plate 4. A current controlling circuit 19 is connected to the electromagnet 18 to control intensity and direction of the magnetic field H0.

Figure 5C:
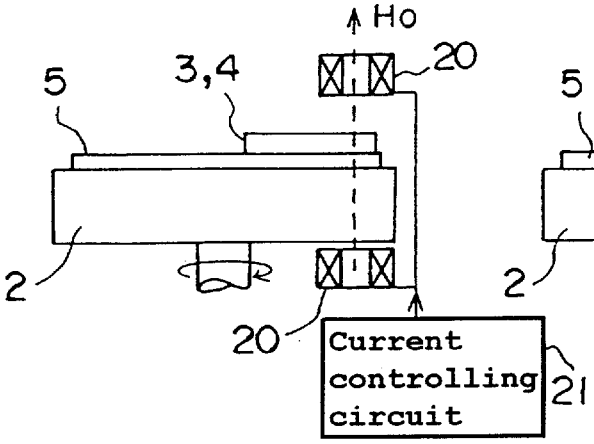

The magnetic field applying means shown in FIG. 5C includes a Hemholtz coil 20 which is arranged over or under a moving area of the supporting plate 3. A current controlling circuit 21 is connected to the Hemholtz coil 20 to control intensity and direction of the magnetic field H0.

Figure 5D:
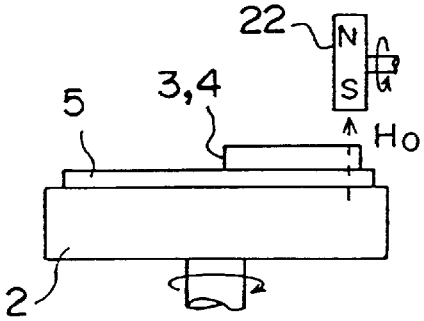

In addition, the magnetic field applying means shown in FIG. 5D includes a permanent magnet 22 which is arranged rotatably over or under a moving area of the supporting plate 3. Direction of the magnetic field H0 can be varied in compliance with rotation of the permanent magnet 22.

Next, explanation will be made of a method which polishes a top end of the MR device 16 by an optimal amount with the use of the above polishing apparatuses.

Figure 6A:
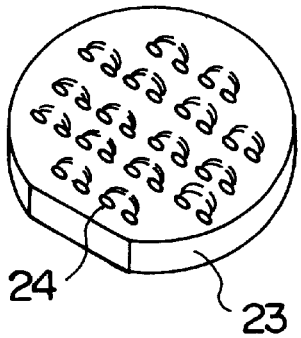
FIG. 6A is a perspective view showing a state where a plurality of magnetic heads to be a polished object of the present invention are formed on a substrate.
Figure 7:
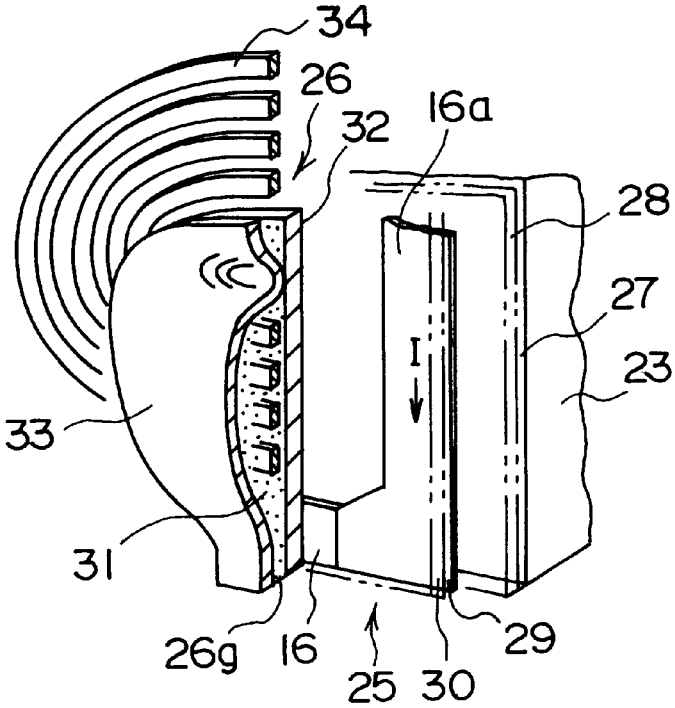
FIG. 7 is an exploded perspective view showing an example of a magnetic head to be a polished object of the present invention.

First, as shown in FIG. 6A, a plurality of magnetic heads 24 are formed on a substrate 23 formed of Al203TiC, or the like in vertical and lateral directions. As shown in FIG. 7, the magnetic head 24 includes an MR head 25 and an inductive type head 26, both being stacked on the substrate 23.

The MR head 25 has an MR device 16, both ends of which are connected to a pair of leading terminals 16*a*. Shielding layers 28, 30 are formed on and beneath the MR device 16 via gap layers 27, 29 made of non-magnetic insulating material.

The inductive type head 26 is formed as a write only head, and has a coil 34 which is sandwiched by a lower magnetic pole 32 and an upper magnetic pole 33 via a non-magnetic insulating layer 31. A write gap 26 exists at tops of the lower magnetic pole 32 and the upper magnetic pole 33.

Figure 6B:
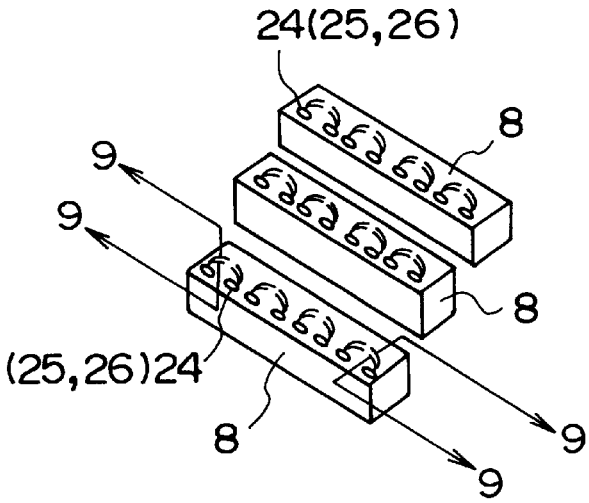
FIG. 6B is a perspective view showing a state where the substrate in FIG. 6A is divided into rod-like blocks.

As shown in FIG. 6B, after the magnetic head 24 is formed, the rod-like blocks 8 on which a plurality of magnetic heads 24 are aligned are formed by cutting off the substrate 23.

Figure 8:
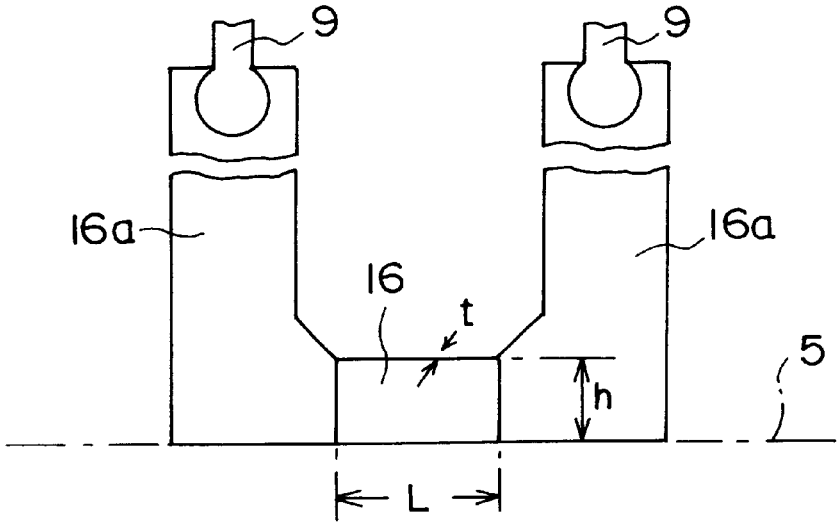
FIG. 8 is a plan view showing a polishing state of a magnetoresistive head to be a polished object of the present invention.

Then, leading wirings 9 shown in FIG. 3B are connected to leading terminals 16*a* (FIG. 7) of two MR head 25 located at both end portions of the rod-like block 8. Succeedingly, the rod-like block 8 is fitted to the recess portion 3*a* of the supporting plate 3. As shown in FIG. 8, the rod-like block 8 is arranged such that top ends of the MR devices 16 abut to the abrasive cloth 5. As shown in FIG. 3A, the supporting plate 3 is secured to a lower surface of the upper surface plate 4 and the leading wirings 9 are connected to the slip rings 10.

Subsequently, based on the drive signals supplied from the controlling section 14, the upper surface plate 4 is rotated by the rotating mechanism 1 and the upper surface plate 4 is brought down and then rotated. With the above operations, the abrasive cloth 5 starts to polish top ends of the magnetic head 24 (25, 26) and the lower surface of the rod-like block 8.

Figure 9:
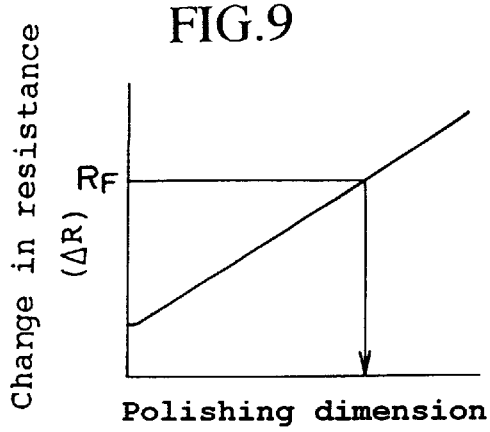
FIG. 9 is a graph showing a relationship between polished dimension of the magnetoresistive device to be polished according to the embodiment of the present invention and change in resistance against a magnetic field.

In the middle of polishing, the alternative magnetic field H0 is applied to the MR head 26 by the magnetic field applying means 17 to 22 as shown in FIGS. 5A to 5D and resistance value is changed according to change in the magnetic field H0. An amount ΔR of change in resistance value can be detected by the resistance value detecting circuit 13 and, as shown in FIG. 9, the amount of change is increased with the progress of polishing operation.

The resistance value detecting circuit 13 detects not only a magnitude of the resistance value but also the amount ΔR of change in the resistance value in accordance with change in the magnetic field, and outputs the polishing terminate signal to the controlling section 14 at an instant when the amount ΔR of change in the resistance value comes up to a predetermined value RF. Here the "predetermined value" is substantially equal to or greater than an amount of change in the resistance value of the MR device 16 which is required for reproducing signals recorded on the magnetic recording medium.

Thereby, contact resistance component of the magnetoresistive device and resistance variation component derived from process can be removed from decision elements about detection of the end point of polishing, and an end point of polishing can be determined in the course of polishing.

Assuming that resistance of the MR device 16 is R, contact resistance component of the MR device 16 is Rcon, resistance variation component of the MR device 16 derived from process is Rpro, and resistance variation component of the MR device 16 caused by the magnetic field is R(H), a following equation (1) can be satisfied.

$$R=Rcon\pm Rpro+R(H) \tag{1}$$

Where there is no magnetic-field intensity dependent parameter in the contact resistance component Rcon and resistance variation component Rpro derived from process.

The contact resistance component Rcon includes contact resistance components of the leading wirings 9, the brushes 11, and the like.

As shown in FIG. 8, assuming that a length of a lead connecting area of the MT device 16 is L, a remaining height of the MR device 16 is h, a film thickness of the MR device 16 is t, and electric conductivity of the MR device 16 is ρ, a following equation (2) can be satisfied.

$$R(H)=L\times\rho/(t\times h) \tag{2}$$

With the progress of polishing, reduction in the height h causes increase in R(H). However, the height h has no dependency on the magnetic field, and the length L is constant during polishing. Hence, only ρ has dependency on the magnetic field in the equation (2).

If the equation (1) is differentiated by the magnetic field, rate of resistance change can be obtained, as given by a following equation (3).

$$dR/dH=dR(H)/dH=K\times d\rho/dH \tag{3}$$

K: constant value

This rate of resistance change can be detected as voltage change Eout in the resistance value detecting circuit 13, as shown in a following equation (4), where is in constant current in the equation (4).

$$Eout=Is\times(dR/dH) \tag{4}$$

Figure 10A:
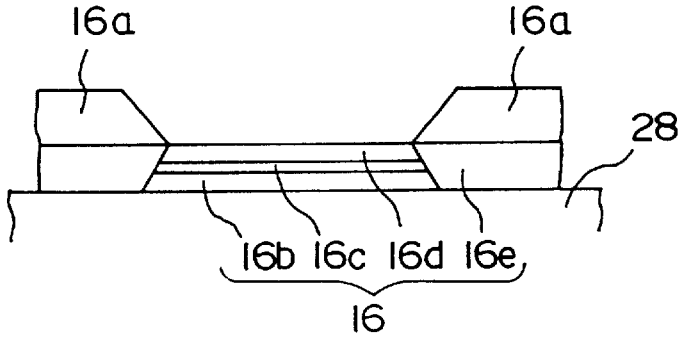
FIG. 10A is a side view showing a layer structure of an anisotropic magnetoresistive head to be polished according to the embodiment of the present invention.
Figure 10B:
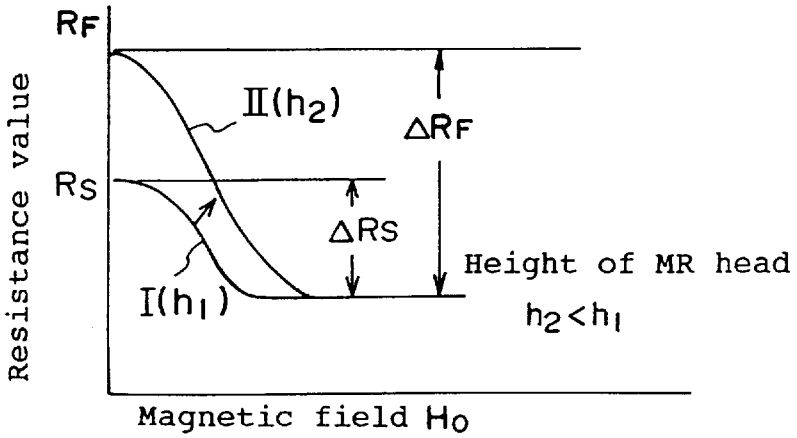
FIG. 10B is a graph showing a magnetic field-resistance characteristic curve based on difference in height of the anisotropic magnetoresistive head.

Subsequently, a structure of an anisotropic magnetoresistive MR head 25 is shown in FIG. 10A, and an amount ΔR of change in the resistance value of the MR device 16 relative to the magnetic field is shown in FIG. 10B.

In FIG. 10A, the MR device 16 which is formed on a lower gap layer 28 comprises a SAL (Soft Adjacent Layer) 16*b* formed of NiFeCr, a non-magnetic layer 16*c* formed of Cu, and an MR layer 16*d* formed of NiFe. Hard magnetic layers 16*e* made of CoCrPt are formed on both sides of the MR device 16. The hard magnetic layers 16*e* are magnetized in the parallel direction to a top surface of the MR layer 16*d* (a surface opposing to magnetic recording medium). Further, a pair of leads 16*a* made of Au are connected on the hard magnetic layers 16*e*.

When such MR device 16 is polished by making use of the polishing apparatus shown in FIG. 3A, as shown in FIG. 10B, the magnetic field-resistance value characteristic is shifted from curve I to curve II with the progress of polishing of the MR device 16. An amount ΔR of change in the resistance value with respect to change in the magnetic field H0 is increased gradually from ΔRs. Polishing is terminated when the amount ΔR of change comes up to a predetermined magnitude ΔRF. In this event, although resistance values Rs and Rf are varied, such resistances are not recognized as monitoring object in the present embodiment. After the SAL layer 16*b*, the non-magnetic layer 16*c* and the MR layer 16*d* are formed and patterned, the hard magnetic layers 16*e* and the leads 16*a* are connected, whereby the MR device 16 in FIG. 10A is completed.

Figure 11A:
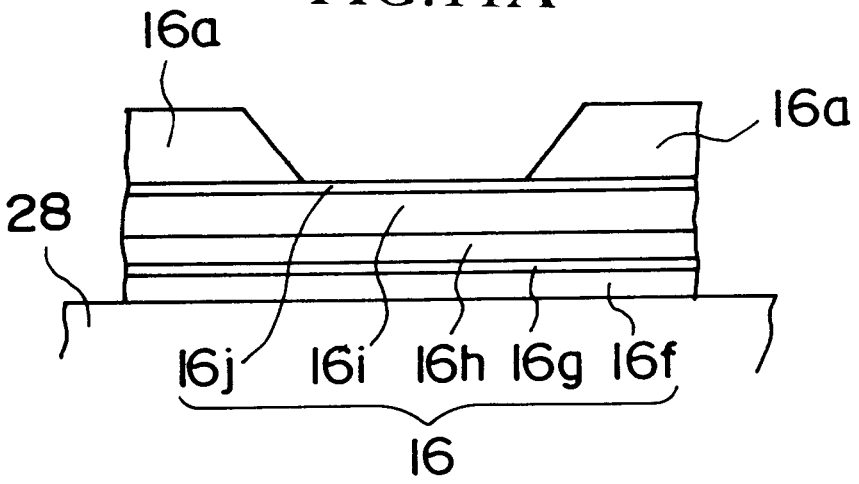
FIG. 11A is a side view showing a layer structure of a spin valve MR head to be polished according to the embodiment of the present invention.
Figure 11B:
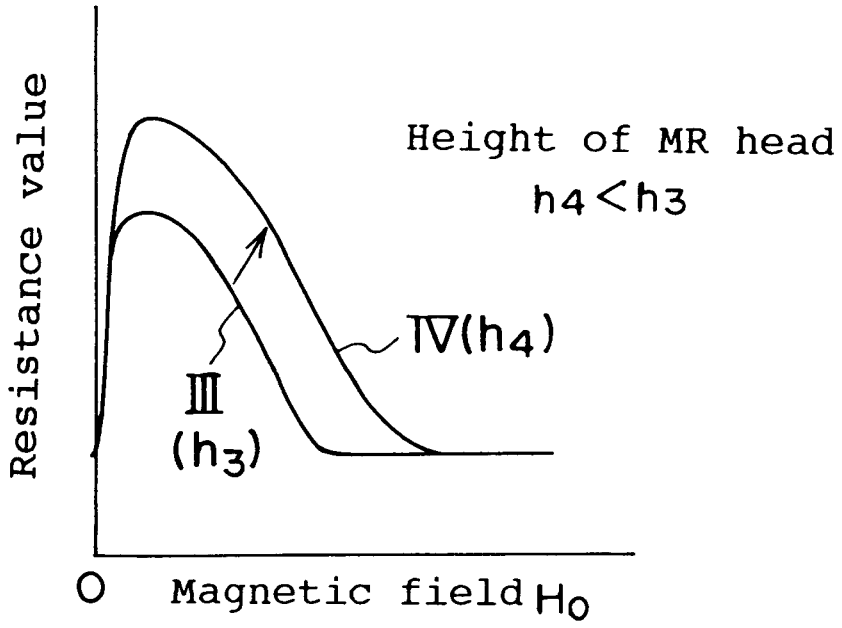
FIG. 11B is a graph showing a magnetic field-resistance characteristic curve based on difference in height of the spin valve MR head.

Next, a structure of a spin valve type MR head 25 is shown in FIG. 11A, and an amount ΔR of change in the resistance value of the MR device 16 relative to the magnetic field is shown in FIG. 11B.

In FIG. 11A, the MR device 16 which is formed on a lower gap layer 28 comprises a magnetization free layer 16*f* formed of NiFe, a non-magnetic layer 16*g* formed of Cu, an magnetization pinning layer 16*h* formed of NiFe, an antiferromagnetic layer 16*i* formed of FeMn, and a protection layer 16*j* formed of Ta. Further, a pair of leads 16*a* made of Au are connected on both side portions of the protection layer 16*j*.

When such MR device 16 is polished from a height h3 to h4 by making use of the polishing apparatus shown in FIG. 3A, as shown in FIG. 11B, the magnetic field-resistance value characteristic is shifted from curve III to curve IV with the progress of polishing of the MR device 16. An amount ΔR of change in the resistance value with respect to change in the magnetic field H0 is increased gradually from ΔRs. Polishing is terminated when the amount ΔR of change comes up to a predetermined magnitude ΔRF.

After respective layers from the magnetization free layer 16*f* to the protection layer 16*j* are formed and patterned, the leads 16*a* are connected, whereby the MR device 16 in FIG. 11A is completed.

Figure 12:
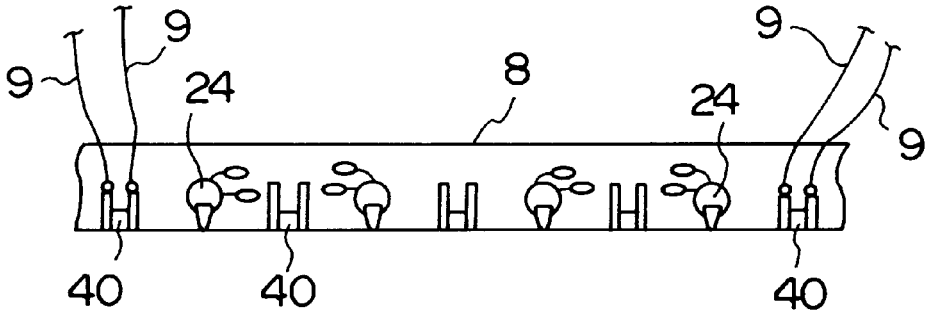
FIG. 12 is a plan view showing a monitoring pattern to be a measured object of change in resistance according to the embodiment of the present invention.

In the above explanation, the amount ΔR of change in the resistance value of the MR device 16 with respect to the magnetic field H0 has been used to measure an amount of polishing. In addition to this, as shown in FIG. 12, monitoring patterns 40 having the same layer structure as shown in FIGS. 10A and 11A may be formed on the side of the MR head 24 and magnitude of the amount Δ R of change in the resistance value of the monitoring patterns 40 may be used as a measuring object. Since the monitoring patterns 40 have the same structure as the MR device 16, the same results can be obtained as the case where the amount ΔR of change in the resistance value of the MR device 16 has been measured. Therefore, labor to remove the leading wirings 9 from the MR device 16 can be omitted and the MR device 16 is less damaged upon polishing operation.

Figure 13:
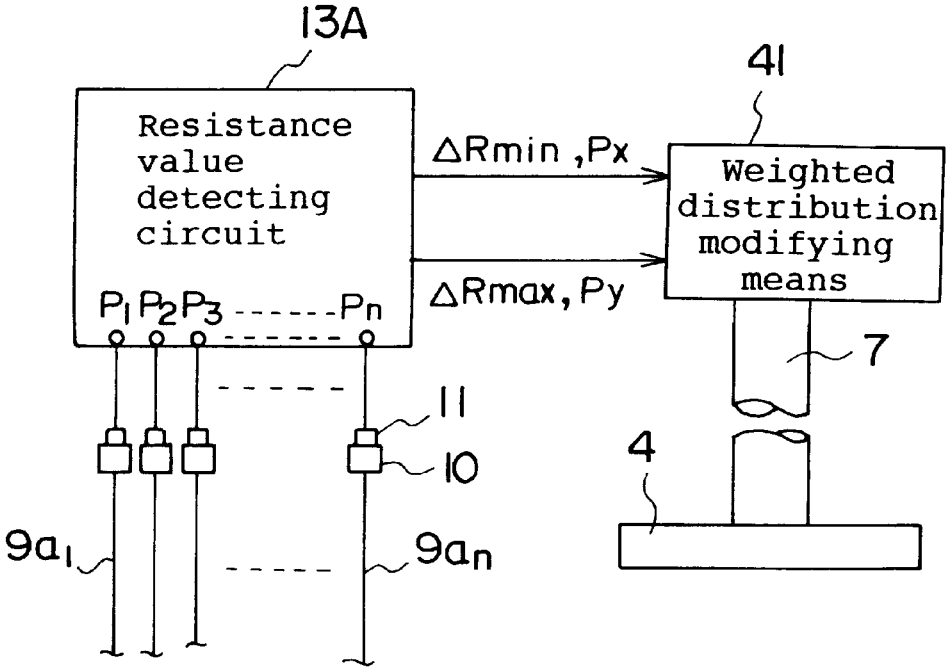
FIG. 13 is a view showing a configuration for adjusting unevenness of polishing if change in resistance of a plurality of magnetoresistive heads or monitoring patterns is measured according to the embodiment of the present invention.

Detected objective locations P1 to Pn of the MR devices 16 or monitoring patterns 40 formed on both sides of the rod-like block 8 on the upper surface plate 4 can be connected to a resistance value detecting circuit 13A, as shown in FIG. 13, while correlating them with the leading wirings 9*a*1 to 9*an* one by one. In this event, as with at least two MR devices 16 or plural monitoring patterns 40 as the measuring object, the resistance value detecting circuit 13A measures the amount ΔR of change in the resistance value of the MR device 16 with respect to change in the magnetic field. If variation is present in plural amounts ΔR of changes in the resistance values, the maximum amount ΔRmax of changes in the resistance value which is associated with the detected objective locations Py is output to a weighted distribution modifying means 41, and also the minimum amount ΔRmin of changes in the resistance value which is associated with the detected objective locations Px is output to a weighted distribution modifying means 41. In the weighted distribution modifying means 41, inclination of the shaft 7 is adjusted or inclination of the lower surface plate 2 is adjusted such that weight to the detected objective locations Px on the upper surface plate 4 is increased while weight to the detected objective locations Py on the upper surface plate 4 is decreased. As a result, uniformity of polishing of the MR devices 16 or plural monitoring patterns 40 can be assured. In the event that error of plural amounts ΔR of changes in the resistance values resided within a tolerance limit, polishing will be stopped at the time when all amounts ΔR of changes in the resistance values exceed the end point detecting value.

Figure 6C:
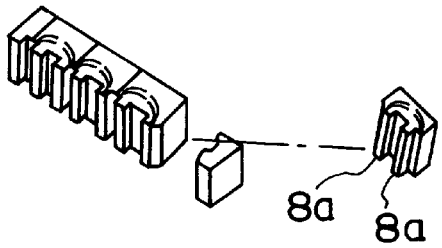
FIG. 6C is a perspective view showing a state where the rod-like blocks in FIG. 6B are split into sliders.

As shown in FIG. 6C, rail surfaces 8*a* are formed on the top side of the MR device 16 on the rod-like block 8 which is subjected to the above polishing, and then the rod-like block 8 is divided into plural slider with magnetic head.

Meanwhile, change in the resistance value shown in FIGS. 10B and 11B may be displayed on a display section 35 shown in FIG. 3A, which enable to determine polishing termination manually.

In addition, in addition to those shown in FIGS. 5A to 5D, the inductive type head 26 shown in FIG. 7 may be used as the magnetic field generating means used in polishing. By supplying electric current to the inductive type head 26 to generate the magnetic field, the amount ΔR of change in the resistance value of the MR device 16 may be detected.

Various modifications will become possible for those skilled in the art after receiving the teachings of the present disclosure without departing from the scope of the present invention.

What is claimed is:

1. A method of manufacturing a magnetic head containing a magnetoresistive head, the method comprising the steps of:

forming on a substrate a magnetoresistive device which constitutes a major part of said magnetoresistive head;

polishing a top end portion of said magnetoresistive device while applying an external magnetic field whose intensity is changing and monitoring a change in resistance of said magnetoresistive device relative to a change in said external magnetic field; and ceasing said polishing step when a monitored change in resistance reaches a predetermined value.

2. The method according to claim 1, wherein said reproducing head uses said magnetoresistive device for reproduction only.

3. The method according to claim 1, further comprising a step of forming a monitoring pattern having the same structure as said magnetoresistive device on at least one side of said magnetoresistive device on said substrate.

4. The method according to claim 1, wherein the change in said external magnetic field is caused by flowing an electric current through an electromagnetic coil and changing a magnitude or direction of said electric current.

5. The method according to claim 1, wherein the change in said external magnetic field is caused by changing a position of a permanent magnet.

6. The method according to claim 1, further comprising a step of forming an inductive type magnetic head on said substrate, wherein said external magnetic field is generated by causing an electric current to flow through said inductive type magnetic head.

7. An apparatus for polishing a magnetoresistive head, comprising:

polishing means for polishing a top end portion of a magnetoresistive device which is formed on a substrate and which constitutes a major part of said magnetoresistive head;

applying means for applying an external magnetic field to said magnetoresistive device while changing its intensity; and detecting means for detecting a change in resistance of said magnetoresistive device relative to a change in said external magnetic field.

8. The apparatus according to claim 7, wherein said applying means is a permanent magnet arranged so as to periodically change its position relative to said magnetoresistive device.

9. The apparatus according to claim 7, wherein said applying means is an electromagnetic coil arranged so as to generate a variable magnetic field.

10. The apparatus according to claim 7, wherein said applying means is an inductive type magnetic head formed near said magnetoresistive head.

11. The apparatus according to claim 7, wherein a plurality of said magnetoresistive devices are formed on said substrate, and further comprising a mechanism for detecting a difference in said change in resistance between at least two magnetoresistive devices and adjusting a weighted distribution to reduce the difference.

12. An apparatus for polishing a plurality of magnetoresistive heads, comprising:

polishing means for polishing a top end portion of a plurality of magnetoresistive devices formed on a substrate;

applying means for applying an external magnetic field to each said magnetoresistive device while changing an intensity of the magnetic field;

detecting means for detecting a change in resistance of each said magnetoresistive device relative to a change in said external magnetic field; and a mechanism for detecting a difference in said change in resistance between at least two magnetoresistive devices and adjusting a weighted distribution to reduce the difference.

13. An apparatus for polishing a magnetoresistive head, comprising:

a polishing member for polishing a top end portion of a magnetoresistive device formed on a substrate;

a variable strength magnetic member for applying a variable intensity magnetic field to the magnetoresistive device;

an electric resistance detector for detecting a change in resistance of the magnetoresistive device relative to a change in the external magnetic field;

a controller operably connected to said electric resistance detector and said polishing member, wherein said controller terminates a polishing operation of said polishing member when a change in resistance detected by said electric resistance detector reaches up to a predetermined value.

* * * * *